US006902372B2

(12) United States Patent
Liang

(10) Patent No.: US 6,902,372 B2
(45) Date of Patent: Jun. 7, 2005

(54) COOLING SYSTEM FOR A TURBINE BLADE

(75) Inventor: George Liang, Palm City, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 56 days.

(21) Appl. No.: 10/654,749

(22) Filed: Sep. 4, 2003

(65) Prior Publication Data

US 2005/0053458 A1 Mar. 10, 2005

(51) Int. Cl.[7] ..... F04D 29/38
(52) U.S. Cl. ..... 415/115; 416/96 R; 416/97 R
(58) Field of Search ..... 415/115, 116; 416/90 R, 416/95, 96 R, 97 R, 97 A

(56) References Cited

U.S. PATENT DOCUMENTS

| | | | | |
|---|---|---|---|---|
| 3,628,885 | A | 12/1971 | Sidenstick et al. | |
| 5,599,166 | A | 2/1997 | Deptowicz et al. | |
| 5,690,472 | A | 11/1997 | Lee | |
| 5,931,638 | A | 8/1999 | Krause et al. | |
| 6,132,169 | A | 10/2000 | Manning et al. | |
| 6,200,087 | B1 | 3/2001 | Tung et al. | |
| 6,286,303 | B1 | 9/2001 | Pfligler et al. | |
| 6,290,462 | B1 | 9/2001 | Ishiguro et al. | |
| 6,305,903 | B1 | 10/2001 | Semmler et al. | |
| 6,328,531 | B1 | 12/2001 | Bariaud et al. | |
| 6,347,923 | B1 | 2/2002 | Semmler et al. | |
| 6,382,907 | B1 * | 5/2002 | Bregman et al. | 416/97 R |
| 6,481,966 | B2 | 11/2002 | Beeck et al. | |
| 6,481,967 | B2 | 11/2002 | Tomita et al. | |
| 6,491,496 | B2 | 12/2002 | Starkweather | |
| 6,499,949 | B2 | 12/2002 | Schafrik et al. | |
| 6,514,037 | B1 | 2/2003 | Danowski et al. | |
| 6,514,042 | B2 | 2/2003 | Kvasnak et al. | |
| 6,561,758 | B2 | 5/2003 | Rinck et al. | |
| 6,769,875 | B2 * | 8/2004 | Tiemann | 416/97 R |

* cited by examiner

*Primary Examiner*—Edward K. Look
*Assistant Examiner*—Dwayne J. White

(57) ABSTRACT

A turbine blade for a turbine engine having an impingement cooling system in at least the trailing edge of the turbine blade. The cooling system may include one or more first impingement ribs positioned generally parallel to the trailing edge and impingement ribs positioned obliquely relative to the first impingement ribs forming one or more triangular cavities. The impingement ribs may include orifices for allowing cooling gases to flow through the triangular cavities and be exhausted through the trailing edge of the turbine blade. The orifices in the second and third impingement ribs may be positioned obliquely relative to the an outer wall.

20 Claims, 5 Drawing Sheets

COOLING SYSTEM FOR A TURBINE BLADE

FIELD OF THE INVENTION

This invention is directed generally to turbine blades, and more particularly to hollow turbine blades having an intricate maze of cooling channels for passing gases, such as air, to cool the blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Operation of a turbine engine results is high stresses being generated in numerous areas of a turbine blade. Some turbine blades have outer walls, referred to herein as housings, formed from double walls, such as an inner wall and an outer wall. Typically, cooling air flows through a cavity defined by the inner and outer walls to cool the outer wall. However, uneven heating in the inner and outer walls of a turbine blade still often exists.

Thus, a need exists for a turbine blade that effectively dissipates heat in a turbine blade.

SUMMARY OF THE INVENTION

This invention relates to a turbine blade capable of being used in turbine engines and having a turbine blade cooling system for dissipating heat from inner aspects of the blade. The turbine blade may be a generally elongated blade having a leading edge, a trailing edge, and a tip at a first end opposite a root for supporting the blade and for coupling the blade to a disc. The turbine blade may also include at least one cavity forming a cooling system. The cooling system may be defined in part by an outer wall defining the cavity and may include an impingement cooling system in the trailing edge of the blade. The impingement cooling system may be particularly suited for use in blades having conical tips, which often generate a greater amount of trailing edge tip vibration than blades having tips with other configurations. Even so, the cooling system may be used in turbine blades having tips with other configurations.

The impingement cooling system may include one or more first impingement ribs positioned generally parallel to the trailing edge of the elongated blade and in contact with the outer wall. The cooling system may also include one or more second impingement ribs oblique to the first impingement rib and extending from the first impingement rib toward the trailing edge. In addition, the cooling system may include one or more third impingement ribs oblique to the first impingement rib and intersecting the second impingement rib. The third impingement rib may extend from the first impingement rib toward the trailing edge of the elongated blade. Intersection of the third impingement rib with the second impingement rib creates at least one triangular cavity. In at least one embodiment, the turbine blade may include a plurality of triangular cavities in the trailing edge of the blade.

Orifices may be placed in the ribs to provide gas flow paths through the impingement cooling system, and in particular, through the plurality of triangular cavities. In at least one embodiment, the first impingement rib may include one or more orifices providing an opening into a triangular cavity through which cooling gases may pass and provide axial impingement cooling. The cooling system may also include one or more orifices in the second impingement rib for providing a gas flow path into a triangular cavity and provide oblique impingement cooling. In some embodiments, the cooling system may include one or more orifices in the third impingement rib and provide oblique impingement cooling.

In at least one embodiment, the cooling system may include three first impingement ribs identified as an outer impingement rib, a middle impingement rib, and an inner impingement rib. A plurality of second and third impingement ribs may extend from the inner impingement rib and may intersect each other, thereby forming a plurality of triangular cavities. Orifices in the first impingement ribs provide axial impingement cooling to the first impingement ribs, and the orifices in the second and third impingement orifices may provide oblique impingement cooling to these ribs.

The first, second, and third impingement ribs increase the cooling capacity of the cooling system in the trailing edge of the turbine blade because, in part, the ribs increase the convective surface upon which the turbine blade may release heat to the cooling gases flowing through the cooling system in the turbine blade. Not only do the ribs increase the cooling capacity of the turbine blade, but the impingement ribs also increase the stiffness of the turbine blade, thereby reducing trailing edge vibration of the turbine blade tip.

During operation, cooling gases flow from the root of the blade through inner aspects of the blade in a cooling system. At least a portion of the cooling gases entering the cooling system of the turbine blade through the base passes through the impingement orifices in the trailing edge of the blade. Cooling gases first pass through orifices in the first impingement rib and into a triangular cavity. The cooling gases are then passed through one or more orifices in the second and third impingement ribs. The cooling gases pass through the triangular cavities formed in the trailing edge and are exhausted through a plurality of orifices in the trailing edge of the turbine blade.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
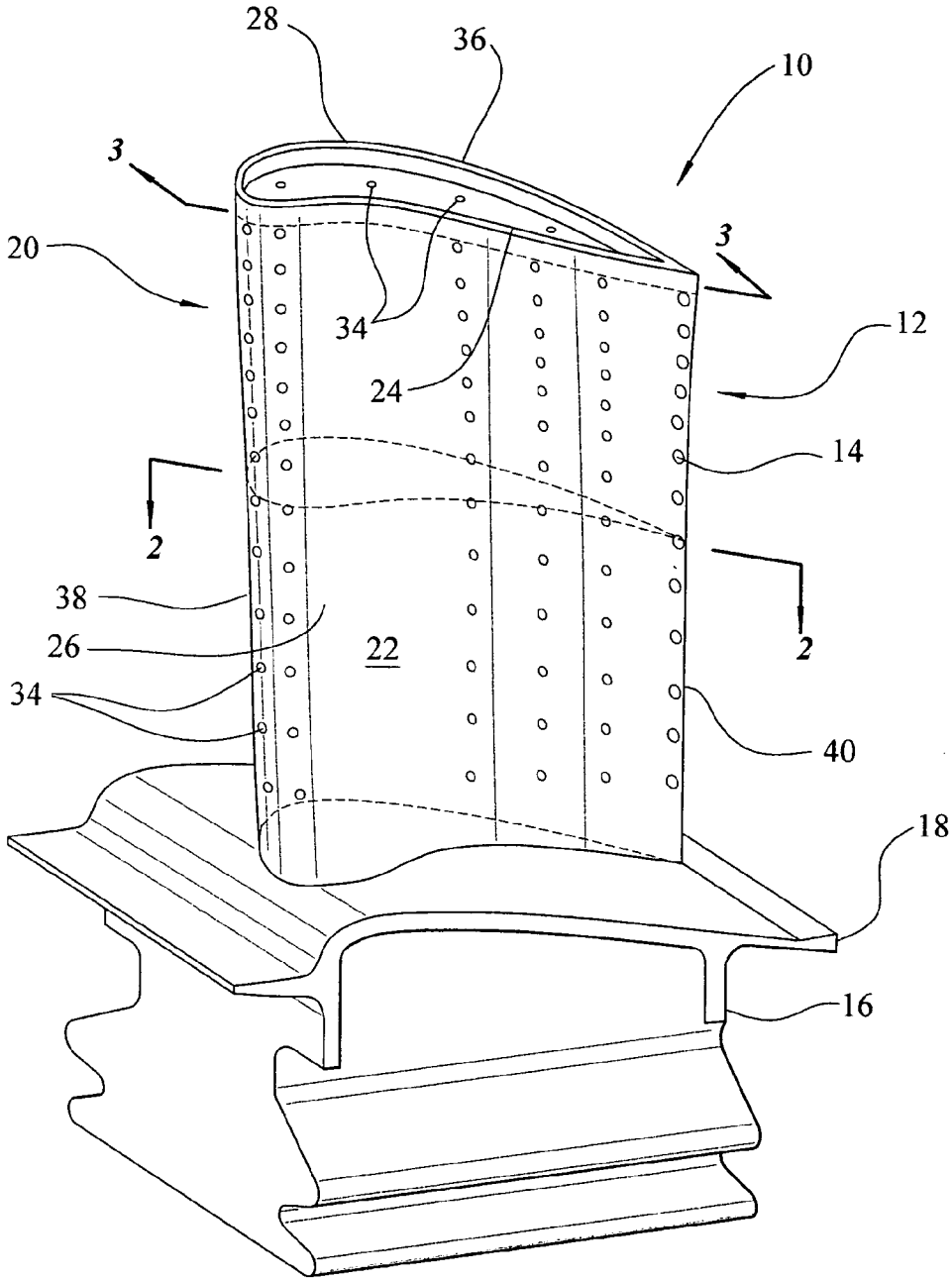
FIG. 1 is a perspective view of a turbine blade having features according to the instant invention.
Figure 2:
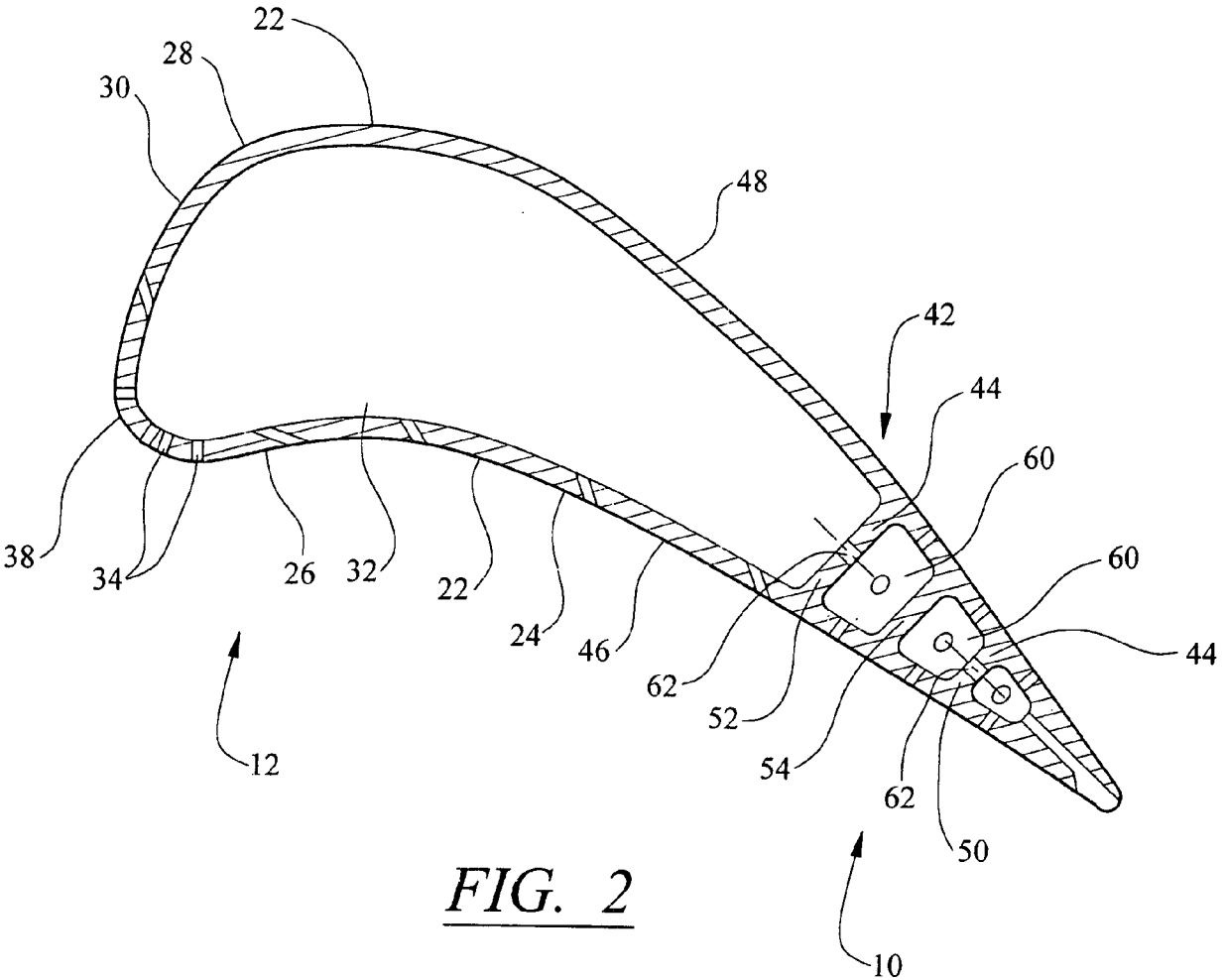
FIG. 2 is cross-sectional view of the turbine blade shown in FIGS. 1 and 4 taken along line 2—2.
Figure 3:
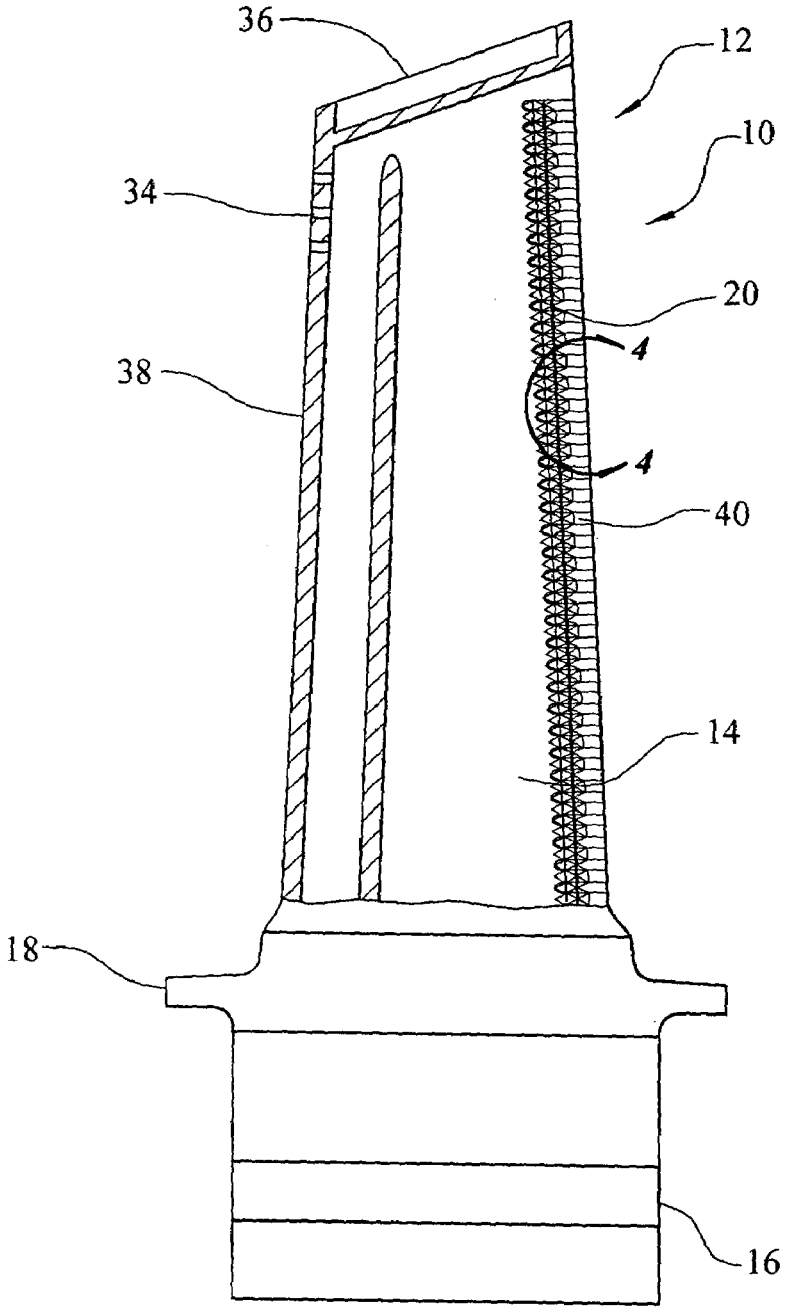
FIG. 3 is a cross-sectional view, referred to as a filleted view, of the turbine blade shown in FIG. 1 taken along line 3—3.

As shown in FIGS. 1–7, this invention is directed to a turbine blade cooling system 10 for turbine blades 12 used in turbine engines. In particular, turbine blade cooling system 10 is directed to a cooling system 10 located in a cavity 14, as shown in FIG. 2, positioned between two or more walls forming a housing 24 of the turbine blade 12. As shown in FIG. 1, the turbine blade 12 may be formed from a root 16 having a platform 18 and a generally elongated blade 20 coupled to the root 16 at the platform 18. Blade 20 may have an outer wall 22 adapted for use, for example, in a first stage of an axial flow turbine engine. Outer wall 22 may be formed from a housing 24 having a generally concave shaped portion forming pressure side 26 and may have a generally convex shaped portion forming suction side 28.

The cavity 14, as shown in FIG. 2, may be positioned in inner aspects of the blade 20 for directing one or more gases, which may include air received from a compressor (not shown), through the blade 20 and out one or more orifices 34 in the blade 20. As shown in FIG. 1, the orifices 34 may be positioned in a tip 36, a leading edge 38, or a trailing edge 40, or any combination thereof, and have various configurations. The cavity 14 may be arranged in various configurations. For instance, as shown in FIG. 2, the cavity 14 may form cooling chambers that extend through the root 16 and the blade 20. In particular, the cavity 14 may extend from the tip 36 to one or more orifices (not shown) in the root 16. Alternatively, the cavity 14 may be formed only in portions of the root 16 and the blade 20. The cavity 14 may have various configurations capable of passing a sufficient amount of cooling gases through the elongated blade 20 to cool the blade 20. As shown in FIG. 2, the cavity 14 may have be a triple pass serpentine cooling system. In other embodiments, the cavity 14 may be a five pass serpentine cooling system or any other configuration that adequately cools the elongated blade 20. In addition, the cavity 14 is not limited to the configuration shown in FIG. 2, but may have other configurations.

Figure 4:
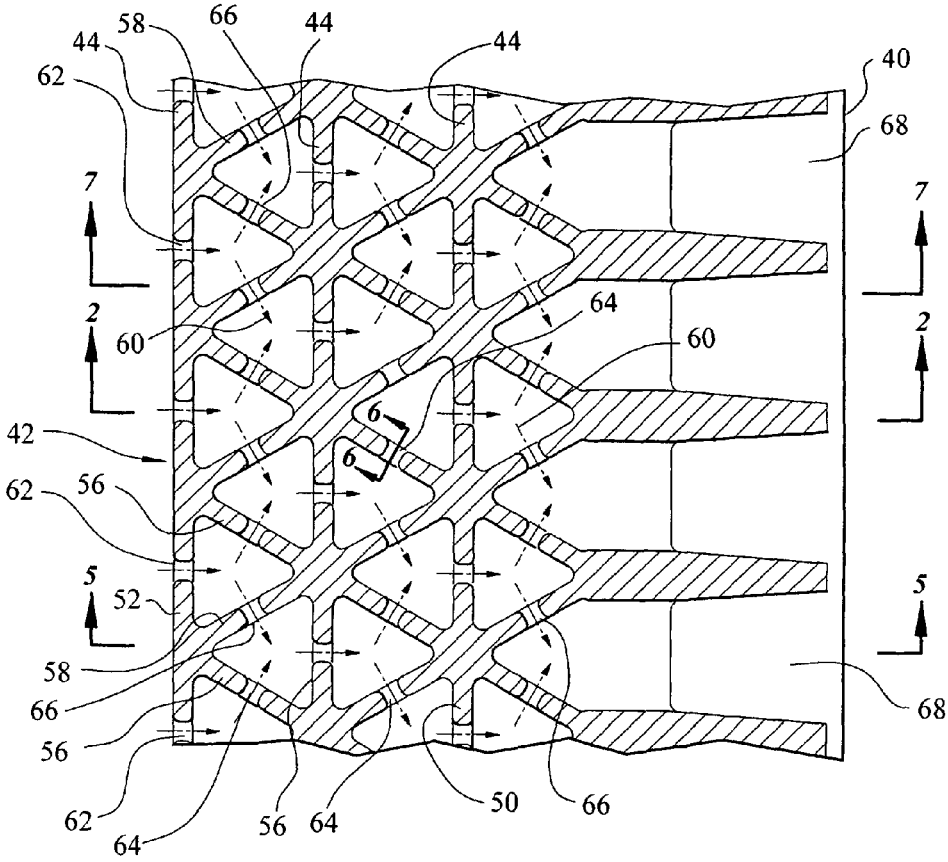
FIG. 4 is a cross-sectional view of the turbine blade shown in FIG. 3 taken along line 4—4.
Figure 5:
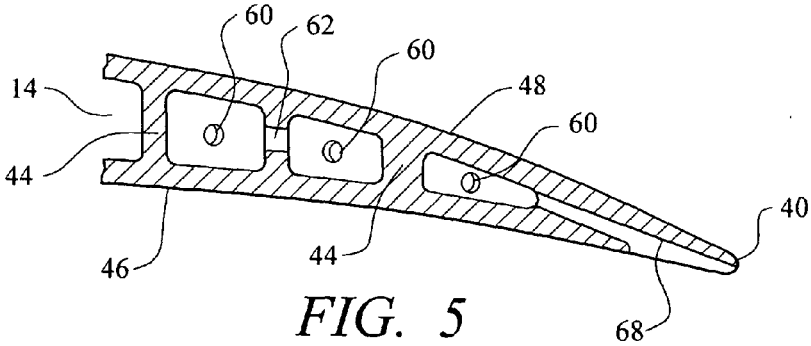
FIG. 5 is a cross-sectional view of the turbine blade shown in FIG. 4 taken along line 5—5.

The turbine blade cooling system 10 may include an impingement cooling system 42 in the trailing edge 40 of the elongated blade 20. The impingement cooling system 42 may be formed from a plurality of ribs for directing cooling gases through the trailing edge 40 of the elongated blade 20 and removing heat from the elongated blade 20. In particular, the impingement cooling system 42 may be formed from one or more first impingement ribs 44. In at least one embodiment first impingement rib 44 may be positioned generally parallel to the trailing edge of the elongated blade 20 and may extend between an inner wall 46 and an outer wall 48. As shown in FIG. 4, the impingement cooling system 42 may include three first impingement ribs 44, which are identified as outer impingement rib 50, inner impingement rib 52, and middle impingement rib 54. Each of the outer, inner, and middle impingement ribs 50, 52 and 54, may be positioned generally parallel to each other. The impingement cooling system 42 is not limited to three first impingement ribs 44, but may include other numbers of ribs 44.

The impingement cooling system 42 may also include one or more second impingement ribs 56 oblique to the first impingement rib 44 and extending from the first impingement rib 44 toward the trailing edge 40. The second impingement rib 56 may extend between the inner and outer walls 46 and 48 and may be positioned between about 45 degrees and about 75 degrees relative to the first impingement rib 44. In at least one embodiment, the second impingement rib 56 may be about 60 degrees relative to the first impingement rib 44.

The impingement cooling system 42 may also include one or more third impingement ribs 58 oblique to the first impingement rib 44. The third impingement rib 58 may extend from the at least one first impingement rib 44 toward the trailing edge 40 and intersect the second impingement rib 56, thereby forming a triangular cavity 60. The third impingement rib 58 may be positioned between about 45 degrees and about 75 degrees relative to the first impingement rib 44. In at least one embodiment, the third impingement rib 58 may be about 60 degrees relative to the first impingement rib 44. The third impingement rib 58 may extend from the inner wall 46 to the outer wall 48 of the blade 20. The third impingement rib 58 may extend from the first impingement rib 44 at an angle measured oppositely to the angle from which the second impingement rib 56 extend from the first impingement rib 44, as shown in FIG. 4, so that the second and third impingement ribs 56 and 58 intersect.

An orifice 62 may be positioned in the first impingement rib 44 so as to provide a gas pathway through the first impingement rib 44 into the triangular cavity 60. Orifice 62 enables axial impingement cooling to occur along the first impingement rib 44. As shown in FIG. 4, the triangular cavity 60 may include a single orifice 62; however, in other embodiments, two or more orifices 62 may be located in the first impingement rib 44 proximate to a single triangular cavity 60 providing a plurality of gas pathways through the first impingement rib 44 into the triangular cavity 60.

Figure 6:
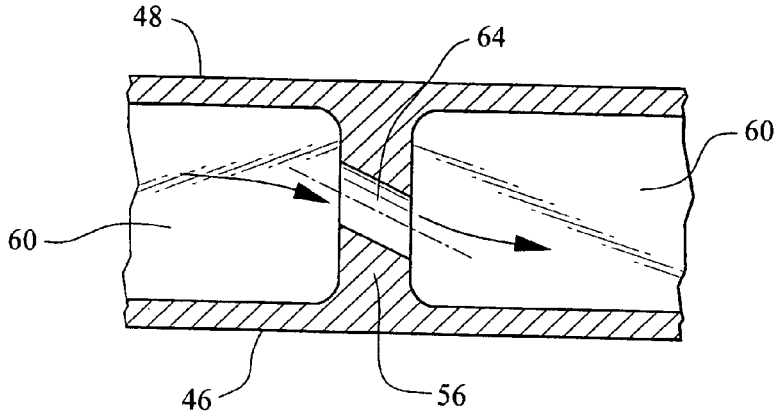
FIG. 6 is a partial cross-sectional view of the turbine blade shown in FIG. 4 taken along line 6—6.

One or more orifices 64 may be located in the second impingement rib 56 to provide oblique impingement cooling to the blade 20. Second impingement rib 56 may include one or a plurality of orifices 64 along the length of the second impingement rib 56. The orifices 64 are preferably positioned in the second impingement rib 56 proximate to a triangular cavity 60. The orifices 64 may be oblique relative to the inner wall 46 or to the outer wall 48, as shown in FIG. 6. The orifices 64 may be positioned so that the air passing through the orifices 64 is directed towards the inner wall 46 and towards the outer wall 48 in an alternating fashion moving towards the trailing edge 40.

In at least one embodiment, as shown in FIG. 2, the impingement cooling system 42 includes three first impingement ribs 44, and a plurality of second and third impingement ribs 56 and 58 forming a plurality of triangular cavities 60. Each triangular cavity 60 may include an orifice 62 in the first impingement rib 44, an orifice 64 in the second impingement rib 56, and an orifice 66 in the third impingement rib 58. The orifice 62 in the first impingement rib 44 provides axial impingement cooling to the first impingement rib 44, and orifices 64 and 66 provide oblique impingement cooling to the second and third impingement ribs 56 and 58, respectively. Orifices 64 and 66 may be oblique relative to the inner wall 46 and to the outer wall 48, as shown in FIG. 6.

Figure 7:
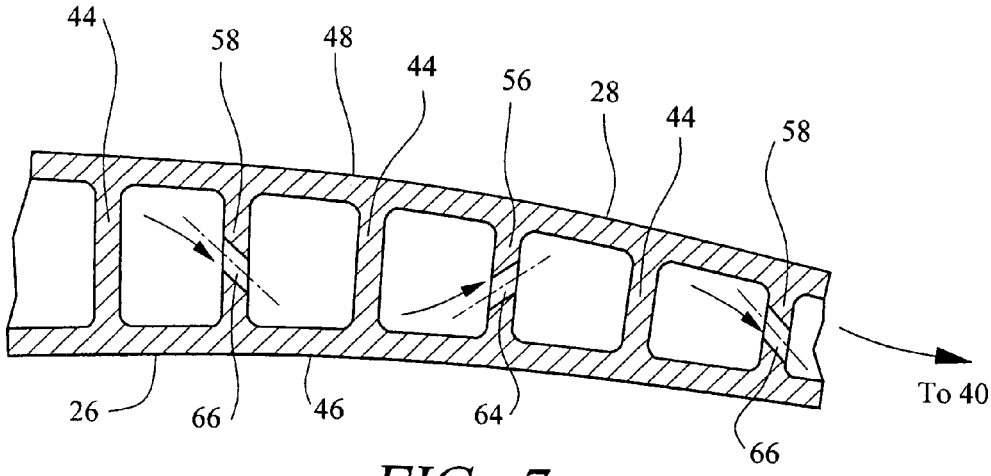
FIG. 7 is a partial cross-sectional-view of the turbine blade shown in FIG. 4 taken along line 7—7.

In each triangle 60, orifices 64 and 66 may be positioned obliquely relative to the inner or outer walls 46 and 48 so that the orifice 64 directs gases to contact the inner wall 46 and the orifice 66 directs gases to contact the outer wall 48, or vice versa. In addition, as shown in FIG. 7, the orifices 64 and 66 may be aligned relative to the inner and outer walls 46 and 48 so that the gases alternate between being directed towards the inner wall 46 and the outer wall 48 as the gas flows through the first impingement ribs 44 towards the trailing edge 40. In particular, in at least one embodiment, the orifices 64 and 66 may be arranged so that a first orifice 66 in a third impingement rib 58 directs gases toward the inner wall 46, an orifice 64 in a second impingement rib 56 directs gases toward an outer wall 48, and an orifice 66 in another third impingement rib 58 directs gases toward the inner wall 46 from upstream toward the trailing edge 40 downstream. The orifices 64 and 66 may be positioned at angles between about 30 degrees and 60 degrees relative to the outer wall 46, and may preferably be about 45 degrees. This configuration removes heat from the turbine blade 12 by impinging the gases on the first, second, and third impingement ribs 44, as the gases flow through the impingement cooling system 42.

While FIG. 4 shows each triangular cavity 60 having at least one orifice 62, 64, and 66, in each of the first, second, and third impingement ribs 44, 56, and 58, the impingement cooling system 42 is not limited to such a configuration. Rather, one or more of the triangular cavities 60 may include only two orifices in any combination of two ribs selected from the first, second, and third impingement ribs 44, 56, and 58. For instance, a triangular cavity 60 may include an orifice 62 in the first impingement rib 44 and an orifice in the second impingement rib 56, but not the third impingement rib 58.

Orifices 62 in the first impingement ribs 44 may be positioned relative to each other so that the orifices 62 in the outer impingement rib 50 are offset radially relative to the orifices 62 in the middle impingement rib 54. Likewise, the orifices 62 in the inner impingement rib 52 may be offset radially relative to the orifices 62 in the middle impingement rib 54. In other embodiments, the orifices 62 in the inner impingement rib 52 may be offset radially relative to the orifices 62 in the middle impingement rib 54 and the orifices 62 in the outer impingement rib 50.

The first, second, and third impingement ribs 44, 56, and 58 increase the stiffness of the elongated blade 20. These ribs 44, 56, and 58 minimize vibrations in the tip 36 of the turbine blade 20. In addition, the first, second, and third impingement ribs 44, 56, and 58 of the first impingement rib 44 and the second and third impingement ribs 56 and 58 increase the surface area of the cavity 14, which increases the surface area available for convection in the turbine blade 20.

During operation, a cooling gas enters the cavity 14 through the root 16. The cooling gases pass through one or more pathways formed in the cavity 14 and cool the turbine blade 12. At least a portion of the gases flowing into the cavity 14 pass into the impingement cooling system 42 in the trailing edge 40. The cooling gases enter the impingement cooling system 42 through the orifices 62 in the first impingement rib 44 and enter triangular cavities 60. The cooling gases mix in the triangular cavities 60 and pass through the orifices 64 and 66 in the second and third impingement ribs 56 and 58, respectively, and are directed towards either the inner wall 46 or the outer wall 48. The cooling gases are then discharged from the impingement cooling system 42 through one or more exhaust orifices 68 in the trailing edge. In at least one embodiment, the exhaust orifices 68 are in the pressure side 26 of the housing 24 of the blade 20.

The impingement cooling system 42 is particularly suited, in part, for use in a turbine blade 12 having a conical tip 38, which often generate a greater amount of trailing edge tip vibration than blades having tips with other configurations. Even so, the impingement cooling system 42 may be used in blades with tips having other configurations.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, and a tip at a first end, a root coupled to the blade at an end generally opposite the first end for supporting the blade and for coupling the blade to a disc, and at least one cavity forming a cooling system in the blade;

the generally elongated blade formed from at least one outer wall defining the at least one cavity forming the cooling system;

at least one first impingement rib positioned generally parallel to the trailing edge of the elongated blade and contacting the at least one outer wall;

at least one second impingement rib oblique to the at least one first impingement rib and extending from the at least one first impingement rib toward the trailing edge;

at least one third impingement rib oblique to the at least one first impingement rib, extending from the at least one first impingement rib toward the trailing edge, and intersecting the at least one second impingement rib, thereby forming at least one triangular cavity;

at least one orifice in the at least one first impingement rib opening into the at least one triangular cavity; and at least one orifice in the at least one second impingement rib opening into the at least one triangular cavity.

2. The turbine blade of claim 1, wherein the at least one orifice in the at least one second impingement rib opening is oblique relative to the outer wall.

3. The turbine blade of claim 2, wherein the at least one orifice in the at least one second impingement rib opening is positioned between about 30 degrees and about 60 degrees.

4. The turbine blade of claim 1, further comprising at least one orifice in the at least one third impingement rib.

5. The turbine blade of claim 4, wherein the at least one orifice in the at least one third impingement rib opening is oblique relative to the outer wall.

6. The turbine blade of claim 5, wherein the at least one orifice in the at least one third impingement rib opening is positioned between about 30 degrees and about 60 degrees.

7. The turbine blade of claim 1, wherein the at least one first impingement rib comprises at least two substantially parallel impingement ribs substantially parallel to the trailing edge.

8. The turbine blade of claim 1, further comprising a plurality of second impingement ribs oblique to the at least one first impingement rib and a plurality of third impingement ribs oblique to the at least one first impingement rib and intersecting at least two of the plurality of second impingement ribs, thereby forming a plurality of triangular cavities.

9. The turbine blade of claim 8, wherein the plurality of second and third impingement ribs oblique to the at least one first impingement rib form a plurality of axial and oblique impingement cooling devices.

10. The turbine blade of claim 9, wherein at least one triangular cavity includes at least one orifice in each side of the at least one triangular cavity.

11. The turbine blade of claim 1, wherein the at least one first impingement rib comprises three substantially parallel impingement ribs forming a plurality of triangular cavities.

12. The turbine blade of claim 11, wherein the at least one orifice in the at least one first impingement rib opening comprises a plurality of orifices in the three substantially parallel impingement ribs, wherein the orifices provide openings into the triangular cavities.

13. The turbine blade of claim 12, wherein the three substantially parallel first impingement ribs comprise an outer impingement rib, an inner impingement rib, and a middle impingement rib and the orifices in the middle impingement rib are offset along the middle impingement rib relative to the orifices in the inner and outer impingement ribs.

14. The turbine blade of claim 1, wherein the at least one second impingement rib is positioned at about 60 degrees relative to the at least one first impingement rib.

15. The turbine blade of claim 1, wherein the at least one third impingement rib is positioned at about 60 degrees relative to the at least one first impingement rib.

16. A turbine engine, comprising:

a combustor positioned upstream from a turbine blade assembly;

the turbine blade assembly having at least one turbine blade;

the at least one turbine blade formed from a generally elongated blade having a leading edge, a trailing edge, and a tip at a first end, a root coupled to the blade at an end generally opposite the first end for supporting the blade and for coupling the blade to a disc, a longitudinal axis extending from the tip to the root, and at least one cavity forming a cooling system in the blade;

the generally elongated blade formed from at least one outer wall defining the at least one cavity forming the cooling system;

at least one first impingement rib positioned generally parallel to the trailing edge of the elongated blade and contacting the at least one outer wall;

at least one second impingement rib oblique to the at least one first impingement rib and extending from the at least one first impingement rib toward the trailing edge;

at least one third impingement rib oblique to the at least one first impingement rib, extending from the at least one first impingement rib toward the trailing edge, and intersecting the at least one second impingement rib, thereby forming at least one triangular cavity;

at least one orifice in the at least one first impingement rib opening into the at least one triangular cavity;

at least one orifice in the at least one second impingement rib opening into the at least one triangular cavity; and at least one orifice in the at least one third impingement rib.

17. The turbine engine of claim 16, further comprising a plurality of first impingement ribs, a plurality of second impingement ribs oblique to the at least one first impingement rib, and a plurality of third impingement ribs oblique to the at least one first impingement rib and intersecting at least two of the plurality of second impingement ribs, thereby forming a plurality of triangular cavities having at least one orifice in each side of the at least one triangular cavity.

18. The turbine engine of claim 17, wherein the at least one orifice in the at least one second impingement rib opening is oblique relative to the outer wall and the at least one orifice in the at least one third impingement rib opening is oblique relative to the outer wall.

19. The turbine engine of claim 18, wherein the at least one orifice in the at least one second impingement rib opening is positioned between about 30 degrees and about 60 degrees and the at least one third impingement rib opening is positioned between about 30 degrees and about 60 degrees.

20. The turbine engine of claim 16, wherein the at least one second impingement rib and the at least one third impingement rib are positioned at about 60 degrees relative to the at least one first impingement rib.

* * * * *